United States Patent [19]

Parramore

[11] 4,432,736

[45] Feb. 21, 1984

[54] WATER-JET STEERING MECHANISMS

[75] Inventor: Thomas S. Parramore, Bournemouth, England

[73] Assignee: The Secretary of State for Defence in Her Britannic Majesty's Government of the United Kingdom of Great Britain and Northern Ireland, London, England

[21] Appl. No.: 352,606

[22] Filed: Feb. 24, 1982

[30] Foreign Application Priority Data

Mar. 2, 1981 [GB] United Kingdom ..... 8106472

[51] Int. Cl.[3] ..... B63H 25/46

[52] U.S. Cl. ..... 440/42; 74/498

[58] Field of Search ..... 114/151, 154, 155, 170, 114/171, 172; 440/42; 239/265.35; 74/498, 710

[56] References Cited

U.S. PATENT DOCUMENTS

| | | | |
|---|---|---|---|
| 2,301,145 | 11/1942 | Russell | 74/498 |
| 2,832,306 | 4/1958 | Hanley | 440/42 |
| 3,874,321 | 4/1975 | Smith | 440/42 |

FOREIGN PATENT DOCUMENTS

| | | | |
|---|---|---|---|
| 684969 | 12/1952 | United Kingdom | 74/498 |
| 1087798 | 10/1967 | United Kingdom | 440/42 |

*Primary Examiner*—Trygve M. Blix
*Assistant Examiner*—Rodney Corl
*Attorney, Agent, or Firm*—Pollock, Vande Sande & Priddy

[57] ABSTRACT

The invention relates to a steering mechanism for a water-jet propelled craft having a rotatable propulsion nozzle. The mechanism comprises a fine steering control and a coarse reversal control. The controls rotate the nozzle via a differential gearbox consisting of four meshed bevel gears rotatable in bearings within a gear cage. The steering control is operative to rotate a gearbox input shaft via a worm and pinion reduction gear, and the reversal control is operative to rotate the cage. The nozzle is connected to a gearbox output shaft. The reduction gear inhibits torque feedback from the reversal control to the steering control and torque feedback from the steering control to the reversal control is inhibited by hydraulic ram actuation of the reversal control.

3 Claims, 3 Drawing Figures

WATER-JET STEERING MECHANISMS

Figure 1:
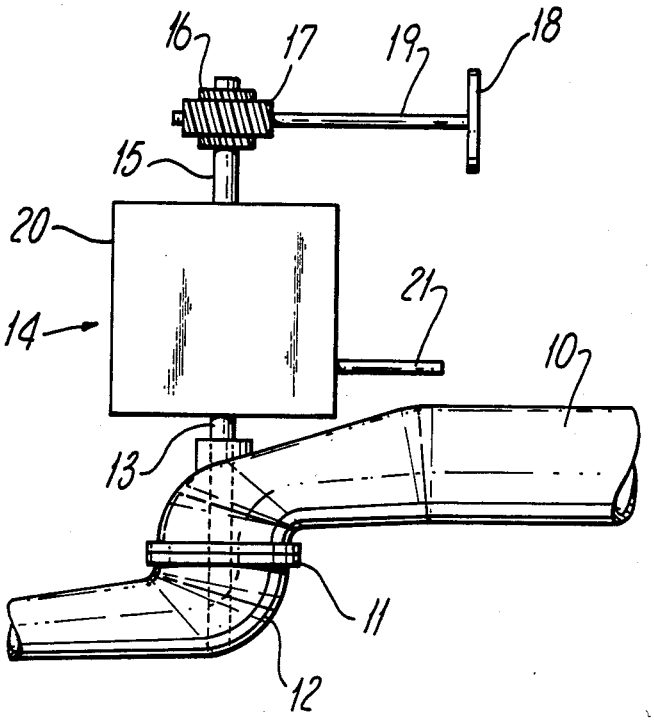

This invention relates to a steering mechanism for water-jet propelled craft, and more particularly to steering mechanisms for such craft equipped with rotatable propulsion nozzles.

Water-jet propelled craft are generally steered in one of two ways. The jet outlet itself may be fixed in direction, and the craft is steered and reversed by deflector surfaces which redirect the jet as described for example in United Kingdom Pat. No. 1,396,676. Alternatively, the jet may issue through a nozzle which is rotatable to redirect the jet and steer the craft, as set out for example in United Kingdom Pat. No. 1,253,814 (White). Of these alternatives, nozzle rotation provides more nearly equal propulsive thrust in the forward and reverse directions. This is an important feature in craft manoeuvrability, since the craft's sensitivity to its throttle control will vary undesirably if the propulsive thrust varies with jet direction. In comparison, the use of deflectors to steer and reverse jet thrust respectively results in maximum reverse thrust being appreciably less than forward thrust. However, against this the use of deflectors can provide independent steering and reversal controls, whereas rotatable nozzles necessarily have interdependent steering and reversal controls with consequent operating difficulties. United Kingdom Pat. No. 1,087,798 (Tamco) describes on Page 6, lines 70 onwards an arrangement providing separate steering and reversal controls operating through an epicyclic gearbox. However, lines 105 to 108 imply that considerable manual dexterity is required to operate the reversal control without affecting nozzle steering.

It is an object of the present invention to provide an improved steering mechanism for the rotatable nozzle of a water-jet propelled craft.

The present invention provides a steering mechanism for a water-jet propelled craft having a rotatable propulsion nozzle, the mechanism including a fine steering control and a coarse reversal control each operative to rotate the nozzle, the reversal control being arranged to rotate the nozzle through 180 degrees, and means for inhibiting torque feedback from either control to the other. By inhibiting torque feedback between the controls in accordance with the invention, the interdependence of the steering and reversal controls is reduced, the controls are easier to operate and the manoeuvrability of the craft is enhanced.

Torque feedback from the reversal control to the steering control may be inhibited by a worm and pinion reduction gear through which the steering control is arranged to rotate the nozzle. Torque feedback from the steering control to the reversal control may be inhibited, and means may be provided to retain the reversal control in the forward or reverse positions unless actuated therefrom. The reversal control may be hydraulic-ram actuated between forward and reverse positions, the ram allowing movement of the reversal control only when hydraulically actuated and being substantially unaffected by the steering control.

The controls may be arranged to operate through a common differential gearbox.

The reversal control may conveniently be interlocked with the water-jet propulsion system such that thrust of the system is reduced during movement of the reversal control into the forward or reverse positions.

In a preferred embodiment of the invention, the controls act via a common gearbox comprising a cage containing a differential arrangement of four bevel gears mounted on shafts each rotatable in a respective bearing retained by the cage, the steering control being operative via an input gearbox shaft and the reversal control being arranged to rotate the cage.

Figure 2:
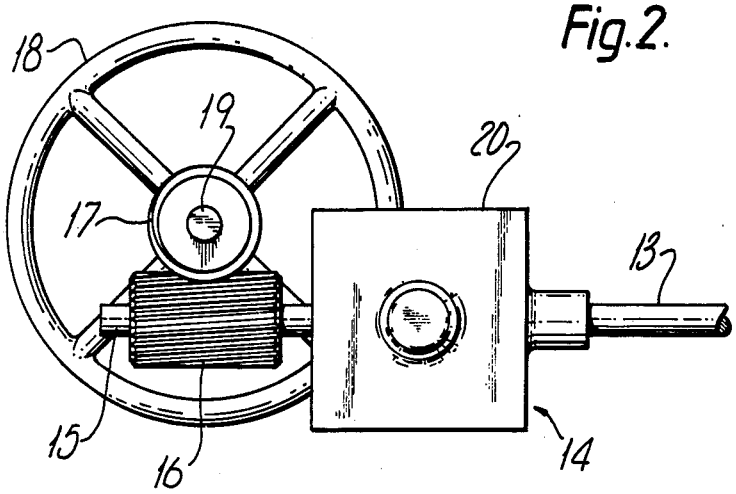
Figure 3:
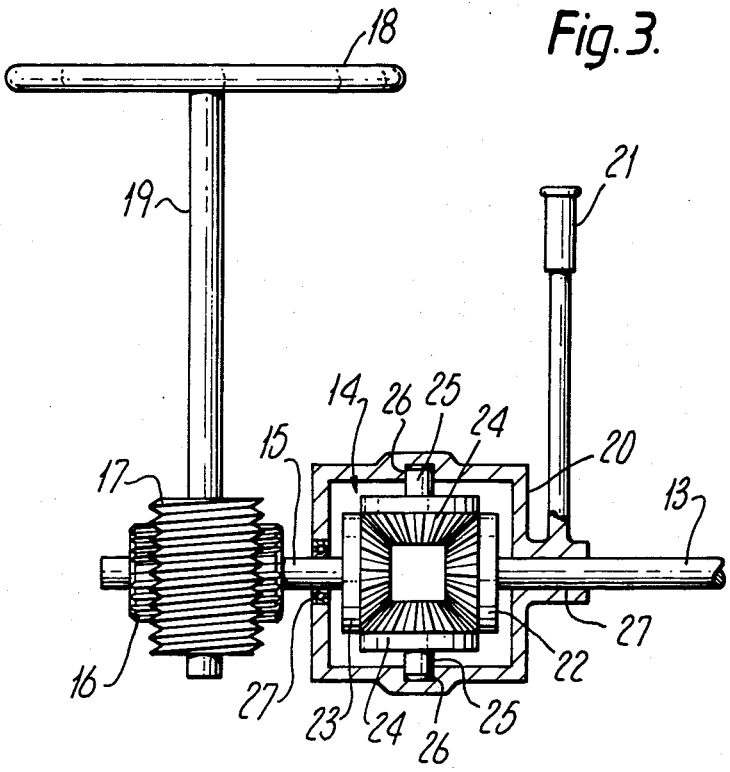

In order that the invention may be more fully understood, one embodiment thereof will now be described, by way of example only, with reference to the accompanying drawings, in which:

FIG. 1 shows schematically a steering mechanism of the invention coupled to a rotatable propulsion nozzle, and FIGS. 2 and 3 respectively show plan and detailed part-sectional side views of a steering mechanism of the invention.

Referring to FIGS. 1, 2 and 3, a water duct 10 is arranged to carry water from an impeller of a water-jet propulsion system (not shown). The duct 10 terminates in a mounting 11 connected to a nozzle 12 rotatable thereon in a horizontal plane. The nozzle 12 is rotatable by an output shaft 13 of a differential gearbox 14. The gearbox 14 has an input shaft 15 carrying a pinion 16 meshed with a worm gear 17. The worm and pinion arrangement effects a 12 to 1 reduction in rotation of the input shaft 15 by a steering or helm wheel 18 mounted on a steering shaft 19 connected to the worm gear 17. The gearbox 14 has a gear cage 20 to which a reversing lever 21 is rigidly attached.

The shafts 13 and 15 are coaxial and terminate in respective output and input bevel gears 22 and 23. Two intermediate bevel gears 24 each mesh with the output bevel gears 22 and 23 in a conventional differential gear arrangement, the bevel gears 22, 23 and 24 being of like dimensions. The intermediate bevel gears 24 are mounted on stub axles 25 rotatable on bearings 26 set in the gear cage 20. The input and output shafts pass within the gear cage 20 through journal bearings 27.

The arrangement of FIGS. 1 to 3 operates as follows. When the input shaft 15 rotates, input bevel gear 23 rotates the gears 24, which then drive the output bevel gear 22 and output shaft 13 in the opposite direction to that of the input shaft 15. The output and input bevel gears 22 and 23 are equal in size and numbers of teeth, so that rotation of the output and input shafts is at the same rate. When the reversing lever 21 is moved through an arc in a plane perpendicular to the shafts 13 and 15 with the helm wheel 18 stationary, the gear cage 20 rotates on the bearings carrying with it the stub axles 25, and the gears 24 roll on the input bevel gear 23. To accommodate rotation of the axles 25 and rolling of the gears 24, the output bevel gear 22 and shaft 13 rotate through twice the angle through which the reversing lever 21 is moved. The lever 21 is arranged for a 90° travel between forward and reverse end points (not shown) corresponding to 180° of nozzle rotation. The action of the differential gearbox gears up nozzle rotation by the reversing lever rotation by a factor of 2 compared to nozzle rotation by the input shaft 15. The reversing lever 21 is accordingly a coarse control of nozzle rotation.

By the reduction arrangement of the worm gear 17 and pinion 16, nozzle rotation by the helm wheel 18 is geared down by a factor of 12, and is therefore geared down by a factor of 24 as compared in the reversing lever 21. The helm wheel 18 accordingly acts as a fine control of rotation of the nozzle 12.

In addition to increasing the reduction in gearing of the helm wheel 18 compared to the reversing lever 21, the use of a worm and pinion arrangement has the additional property of irreversibility. It is well-known in mechanical engineering that a sufficiently high reduction worm and pinion combination will transmit torque from the worm to the pinion but not vice versa. The gear ratio at which irreversibility occurs depends on the angle of friction between the worm and pinion, and the 12 to 1 ratio employed is in excess of the required minimum for all common lubricant/metal gear combinations. Accordingly, operation of the reversing lever 21 does not transmit a torque reaction feedback to the helm wheel 18. To inhibit torque reaction in the opposite direction, ie rotation of the helm wheel producing a tendency to rotate the gear cage 20 and lever 21, locking means (not shown) are provided to lock the reversing lever 21 at either end of its 90° travel. This may be implemented by a hydraulic ram actuator coupled to the lever 21, and operative to move the lever between the forward and reverse positions while being insensitive to operation of the steering control or helm wheel 18.

An interlock (not shown) is provided between the reversing lever and the water jet propulsion system so that power is throttled back while the reversing lever is in a position intermediate forward and reverse. The interlock reduces lateral thrust on the craft when the nozzle is directed abeam during actuation of the reversing control.

Conveniently, the differential gearbox 14 may be provided with means such as shims or spring-loaded gears for reducing backlash.

The invention may incorporate other means for inhibiting torque feedback between the steering and reversal controls. The example of the invention described with reference to FIGS. 1, 2 and 3 incorporates direct mechanical actuation of nozzle rotation, but indirect actuation by hydraulic or electric means may be employed and this may facilitate torque feedback reduction.

Differential operation of the steering and reversal controls may alternatively be achieved without a common differential gearbox, the controls being actuated by motor drive means operative at differential rates. The drive would be adapted to inhibit torque feedback between the controls.

In the arrangement of FIG. 1, the helm wheel 18 is shown located comparatively close to the nozzle 12. It may be more convenient in some craft for the helm wheel to be located remotely from the nozzle. If this is required the input shaft 15 or the steering shaft 19 may be remotely actuated via various known means such as servomechanisms, hydraulic actuators or cables.

The present invention has the advantage that while prior art buckets or scoops for water-jet reversal are not required, independent operation of the steering and reversal controls is preserved. This makes it possible to position a water craft accurately by alternate forward and reverse motion with the nozzle spending a reduced time period directed abeam of the craft and without cumbersome manipulation of interdependent controls. This reduces the lateral displacement of the craft during such positioning and a further reduction is achieved by throttle/reverse control interlock. The forward and reverse thrusts are substantially equal, apart from minor differences introduced by the hull of the craft affecting the jet differently in the forward and reverse positions. Prior art deflector surfaces have the effect of reducing the reverse thrust considerably, so that speed in reverse is reduced and positioning sensitivity varies between the forward and reverse directions.

I claim:

1. In a steering mechanism for a water-jet propelled craft having a rotatable propulsion nozzle, the mechanism including a fine steering control and a coarse reversal control each operative to rotate the nozzle, the reversal control being arranged to rotate the nozzle through 180 degrees, the improvement comprising providing means for inhibiting torque feedback from either control to the other, the steering and reversal controls being arranged to rotate the nozzle via a common differential gear box, said gear box comprising a cage containing a differential arrangement of four bevel gears rotatable in bearings retained by the cage.

2. In a steering mechanism for a water-jet propelled craft having a rotatable propulsion nozzle, the mechanism including a fine steering control and a coarse reversal control each operative to rotate the nozzle, the reversal control being arranged to rotate the nozzle through 180 degrees, the improvement comprising providing means for inhibiting torque feedback from either control to the other, said steering mechanism including a worm and pinion reduction gear for inhibiting torque feedback from the reversal control to the steering control, the steering control being arranged to rotate the nozzle through the reduction gear, the steering and reversal controls being arranged to rotate the nozzle via a common differential gear box, said gear box comprising a cage containing a differential arrangement of four bevel gears rotatable in bearings retained by the cage.

3. A steering mechanism according to claims 1 or 2 wherein the steering control is operative to rotate the bevel gears within the cage via a gearbox input shaft and the reversal control is operative to rotate the cage.

* * * * *